United States Patent [19]

Vogt

[11] 4,162,742

[45] Jul. 31, 1979

[54] EASY OPENING TOP CLOSURE MEMBER FOR A CONTAINER

[76] Inventor: Kuno J. Vogt, 4250½ Fairmont Ave., San Diego, Calif. 92105

[21] Appl. No.: 927,368

[22] Filed: Jul. 24, 1978

[51] Int. Cl.[2] ..... B65D 41/32

[52] U.S. Cl. ..... 220/269; 220/345; 222/541

[58] Field of Search ..... 220/258, 260, 265, 267, 220/269, 270, 331, 366, 345; 229/7 R; 222/541

[56] References Cited

U.S. PATENT DOCUMENTS

| | | | |
|---|---|---|---|
| 3,952,911 | 4/1976 | Bozek et al. | 220/331 X |
| 4,023,703 | 5/1977 | Strope | 220/345 X |
| 4,039,100 | 8/1977 | Wells | 220/267 X |
| 4,113,134 | 9/1978 | Heintzelman | 220/256 |

*Primary Examiner*—George T. Hall
*Attorney, Agent, or Firm*—Charles C. Logan, II

[57] ABSTRACT

An easy opening top closure member for a container having a top member with an aperture of a predetermined configuration. A closure member for the aperture has an exterior portion and an interior portion. The exterior portion is in the form of a retaining ridge that extends upwardly from the interior portion and it functions to provide a surface against which the tip of a finger can be pushed to uncover and also cover the aperture. The interior portion is in the form of a disc whose lateral dimensions are greater than that of the aperture whereby the outer periphery of the disc functions as a pressure sealing lip against the underside of the top member. The lower portion of the retaining ridge is frangibly connected to the disc along a predetermined portion of the retaining ridge whereby either a downward force against a predetermined area of the disc or an upward pulling force against a predetermined portion of the ridge will cause the retaining ridge to separate from the disc along the predetermined frangible portion thereby allowing the closure member to be slid rearwardly and forwardly to respectively open and close the closure member. The lower portion of the retaining ridge that is not frangibly connected to the disc may be of a thickness greater than the frangible portion which allows the thicker portion to function as a hinge connecting the retainer ridge to the disc.

7 Claims, 9 Drawing Figures

EASY OPENING TOP CLOSURE MEMBER FOR A CONTAINER

BACKGROUND OF THE INVENTION

The invention relates in general to container structure and more specifically to an easy opening top closure member for a container.

The popularity of the conventional pop-top beverage container has caused the problem of littering resulting from improper disposal of the tear tab that is detached to open the container. These removable tear tabs which typically have sharp or rough metal edges, are frequently dropped on the ground as soon as the can is opened, thereby creating an unsightly and hazardous situation. Public criticism and dissatisfaction with the conventional pop-top beverage can, with its removable tear tab, has increased to the point were a number of jurisdictions have outlawed such beverage containers or are contemplating doing so.

A preferred solution to the problems created by the conventional pop-top would be an easy opening container which is manually operable by children as well as adults, which provides an effective pouring opening once opened, which presents no psychological barriers to opening or beverage consumption, which is readily producable, and which is economically feasible. While many designs of easy-opening containers have been proposed as substitutes for the conventional pop-top, none is known which effectively meets all foregoing criteria to the satisfaction of the container manufacturer, the beverage packager, and the consumer of canned beverages.

One of the attempts to solve the littering problem is illustrated in U.S. Pat. No. 3,902,626. In the structure illustrated therein, the top of the container has had weakening indentations formed in the exterior surface to provide a fracturable web at the root of the indentation adapted to be fractured by inwardly directed pressure digitally applied against an integral outwardly projecting deflectable portion of the container component around the opening panel. This structure still has the drawback that the opening panel is pushed through the opening in the lid into the contents of the container thereby providing a danger of the opening panel being swallowed. Additionally as the opening panel is pushed through the top of the container there remains the risk of cutting or severing the fingertip as it is pushing the opening panel through the aperture formed in the top of the container Other attempts have been made to design non-detachable easy open flap and tab assemblies such as are illustrated in U.S. Pat. Nos. 3,938,693 and 4,039,100. The major problem with the structures illustrated in these patents is their costliness of manufacture. Both of these structures eliminate the littering problem and also the danger of cutting the finger which is used to open the top.

It is an object of the invention to provide a novel easy opening top closure member for a container that is non-detachable from the container.

It is also an object of the invention to provide a novel easy opening top closure member for a container that eliminates the danger of cutting one's finger when the top closure member is opened.

It is also an object of the invention to provide a novel easy opening top closure member for a container that will not be deposited within the container in such a manner to provide a danger that the person drinking from the container may swallow the top closure member.

It is a further object of the invention to provide a novel easy opening top closure member for a container that is inexpensive to manufacture.

It is an additional object of the invention to provide a novel easy opening top closure member for a container that is recloseable once it has been opened.

SUMMARY OF THE INVENTION

The easy opening top closure member is utilized with a container having a top member with an aperature of a predetermined configuration. The closure member has an exterior portion and an interior portion. The exterior portion is in the form of a retaining ridge that extends upwardly from the interior portion with the retaining ridge functioning to provide a surface against which the tip of a finger can be pushed to uncover and also to over the aperture. The interior portion is in the form of a disc whose lateral dimensions are greater than that of the aperture whereby the outer periphery of the disc functions as a pressure sealing lip against the underside of the top member.

The lower portion of the retaining ridge is frangibly connected to the disc along a predetermined portion of the retaining ridge whereby either a downward force against the predetermined area of the disc or an upward pulling force against a predetermined portion of the ridge will cause the retaining ridge to separate from the disc along the predetermined frangible portion thereby allowing the closure member to be slid rearwardly and forwardly to respectively open and close the closure member. The lower portion of the retaining ridge that is not frangibly connected to the disc is of a thickness greater than the frangible portion and the thicker portion functions as a hinge connecting the retaining ridge to the disc.

The closure member is made of a suitable plastic or metal material that can be used with a beverage can that is made of metal or even a blow-moulded one piece plastic can such as recently has been manufactured.

The disc member may have a concave portion that extends downwardly below the bottom surface of the pressure sealing lip portion of the disc. When this configuration is used, the disc has a fingertip pressure surface that extends laterally inwardly a predetermined distance from the retaining ridge. By applying a downward force to the fingertip pressure surface, the lower portion of the retaining ridge that is frangibly connected to the disc will sever along the predetermined frangible portion. The fingertip pressure surface is hinged at its forward edge to a downwardly extending wall member whose lower edge meets the concave portion of the disc. After the frangible portion has severed, fingertip pressure is applied rearwardly toward the vertical wall of the retaining ridge which will cause the closure member to move rearwardly thus uncovering the aperature in the top of the beverage can. By sliding the closure member back into its pre-opened position, the aperature may be covered again thereby keeping the liquid in and foreign particles out.

The novel closure member is easy to open because the seal which has to be broken is not the seal which contains the pressure of carbonation. Only the retaining ridge has to be separated from the pressure-holding disc portion of the seal when opening the can. The novel closure member is also more sanitary than previous easy-open tops for beverage cans because, after opening the can, the top surface of the disc lies flat against the underside of the top wall of the beverage can and does not extend into the liquid. Neither is the finger immersed, as happens with the push-in top beverage can.

The novel closure member is also much safer than previous easy-open top beverage cans since the retaining ridge only serves to hold the sealing disc in place and to provide a finger hold. Very little strength is needed between the retaining ridge and the disc thus reducing the seal breaking force to the point where little or no recoil occurs in the pull-up mode, or fingers being cut in the push-in mode. During seal breaking, the finger is protected by the retaining ring and the fingertip pressure surface.

In an alternative embodiment of the closure member, the retaining ridge has a laterally inwardly extending flange adjacent the area where the retaining ridge is frangibly connected to the disc whereby a predetermined upward lifting force against this laterally inwardly extending flange will sever the retaining ridge from the disc along the frangible portion. On both designs of closure members, the outer lateral surface of the retaining ridge has a convex portion that functions to prevent the closure member from being pushed inwardly through the aperture in the top member of the container.

DESCRIPTION OF THE PREFERRED EMBODIMENTS

Figure 1:
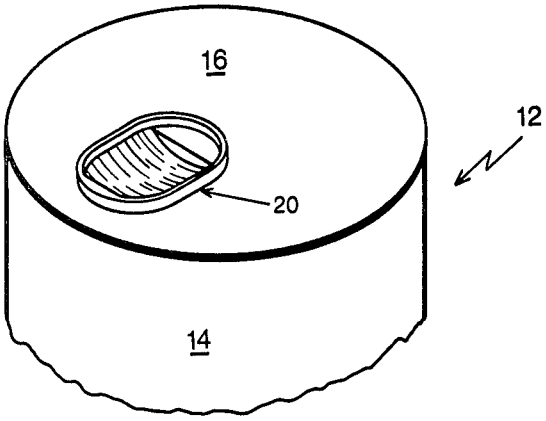
FIG. 1 is a partial perspective view of the top of a can fitted with the novel closure member.
Figure 2:
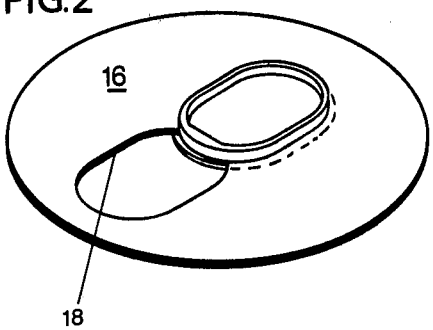
FIG. 2 is a perspective view illustrating the top member of a container with the novel closure member in its open position.
Figure 3:
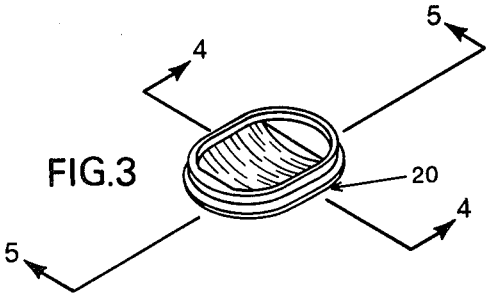
FIG. 3 is a perspective view of the novel closure member.
Figure 4:
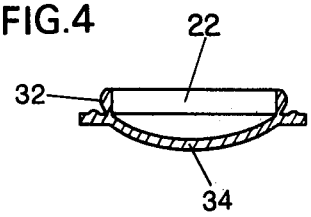
FIG. 4 is a cross-sectional view taken along lines 4—4 of FIG. 3.
Figure 5:
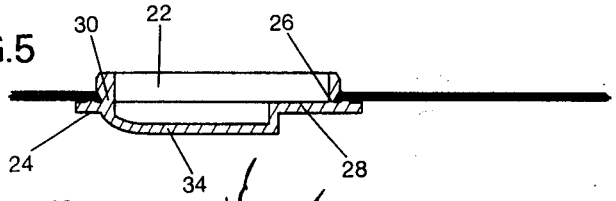
FIG. 5 is a cross-sectional view taken along lines 5—5 of FIG. 3.
Figure 6:
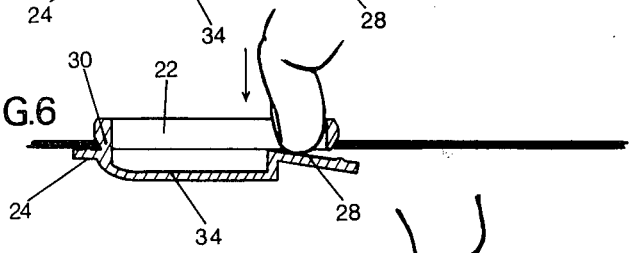
FIG. 6 is a cross-sectional view illustrating how the enclosure member has its retaining ridge severed from the disc member.
Figure 7:
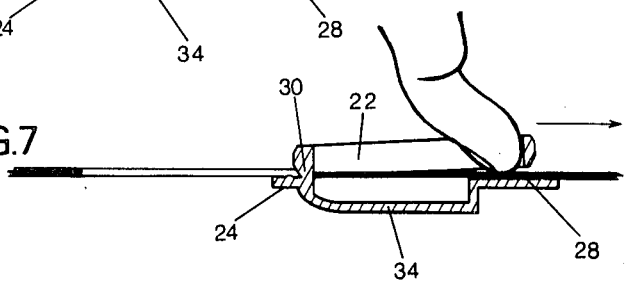
FIG. 7 is a cross-sectional view illustrating the closure member in its open position.

Referring to FIGS. 1–7, the novel closure member will be described. A container made from plastic or metal is generally designated numeral 12 and it has a side wall 14 and a top member 16. An aperature 18 of a predetermined configuration is formed in the top member and into this aperture is fitted the closure member 20.

The exterior portion of the closure member 20 is in the form of a retaining ridge 22 that extends upwardly from a disc member 24 whose lateral dimensions are greater than that of the aperature 18 whereby the outer periphery of the disc functions as a pressure sealing lip against the underside of the top member 16.

The thickness of the material of the retaining ridge is relatively thin along the neck area 26 connecting the retaining ridge 22 to the disc member 24. The thinness of the material makes it easily frangible by either a downward force against the fingertip pressure surface 28 or an upward pulling force against the retaining ridge. The thickness of the material along the lower portion of the retaining ridge at its forward end is thicker and non-frangible to form a hinge 30 that connects the retaining ridge to the disc member after the closure member has been slid to its open position. The retaining ridge 22 is formed in the shape of a ring, and its outer lateral surface has a convex portion 32 that functions to prevent the closure member from being pushed inwardly through the aperature in the top member of the container. The disc may also have a concave portion 34 that extends downward below the bottom surface of the pressure sealing lip portion of the disc 24.

Figure 8:
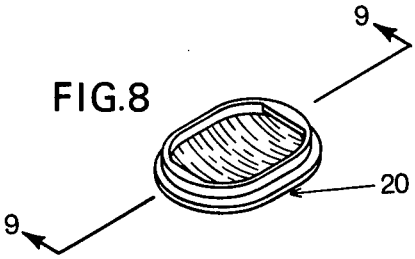
FIG. 8 is a perspective view illustrating an alternative closure member.
Figure 9:
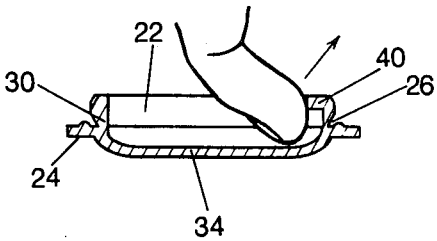
FIG. 9 is a cross-sectional view taken along lines 9—9 of FIG. 8.

The alternative closure member 20 prine is illustrated in FIGS. 8 and 9. Its like structural elements are identified by the like numbers used for identifying the structure of the first closure member. The main difference between the two is the addition of a laterally inwardly extending flange 40 adjacent to the area where the retaining ridge 22 is frangibly connected to the disc 24. By applying a predetermined upwardly force against the laterally inwardly extending flange 40, the lower portion of the retaining ridge will sever from the disc 24 along the frangible portion between the two structural elements.

What is claimed is:

1. An easy opening top closure member for a containing comprising:

a container top member having an aperture of a predetermined configuration, a closure member for said aperture having an exterior portion and an interior portion, said exterior portion being in the form of a retaining ridge that extends upwardly from said interior portion, said retaining ridge functioning to provide a surface against which the tip of a finger can be pushed to uncover and also cover said aperture, said interior portion being in the form of a disc whose lateral dimensions are greater than that of said aperture whereby the outer periphery of said disc functions as a pressure sealing lip against the underside of said top member, and the lower portion of said retaining ridge being frangibly connected to said disc along a predetermined portion of said retaining ridge whereby either a downward force against a predetermined area of said disc or an upward pulling force against a predetermined portion of said retaining ridge will cause said retaining ridge to separate from said disc along said predetermined frangible portion thereby allowing said closure member to be slid rearwardly and forwardly to respectively open and close said closure member.

2. An easy opening top closure member for a container as recited in claim 1 wherein the lower portion of said retaining ridge that is not frangibly connected to said disc is of a thickness greater than said frangible portion and said thicker portion functions as a hinge connecting said retaining ridge to said disc.

3. An easy opening top closure member for a container as recited in claim 1 wherein said retaining ridge is formed in the shape of a ring.

4. An easy opening top closure member for a container as recited in claim 1 wherein said disc has a concave portion that extends downwardly below the bottom surface of the pressure sealing lip portion of said disc.

5. An easy opening top closure member for a container as recited in claim 4 wherein said disc has a finger tip pressure surface that extends laterally inwardly a predetermined distance from said retaining ridge, said finger tip pressure surface being hinged at its inward edge to a downwardly extending wall member whose lower edge meets said concave portion of said disc.

6. An easy opening top closure member for a container as recited in claim 1 wherein said retaining ridge has a laterally inwardly extending flange adjacent the area where said retaining ridge is frangibly connected to said disc whereby a predetermined upwardly lifting force against said laterally inwardly extending flange will sever said retaining ridge from said disc along the frangible portion.

7. An easy opening top closure member for a container as recited in claim 1 wherein the outer lateral surface of said retaining ridge has a convex portion that functions to prevent said closure member from being pushed inwardly through the aperture in the top member of said container.

* * * * *